US012169111B2

(12) United States Patent
Kusnierz

(10) Patent No.: US 12,169,111 B2
(45) Date of Patent: Dec. 17, 2024

(54) AMBIDEXTROUS CHARGING HANDLE

(71) Applicant: Smith & Wesson Inc., Springfield, MA (US)

(72) Inventor: Zachary Kusnierz, Westfield, MA (US)

(73) Assignee: SMITH & WESSON INC., Springfield, MA (US)

( * ) Notice: Subject to any disclaimer, the term of this patent is extended or adjusted under 35 U.S.C. 154(b) by 0 days.

(21) Appl. No.: 18/449,435

(22) Filed: Aug. 14, 2023

(65) Prior Publication Data

US 2024/0053117 A1 Feb. 15, 2024

Related U.S. Application Data

(60) Provisional application No. 63/397,431, filed on Aug. 12, 2022.

(51) Int. Cl.
*F41A 35/06* (2006.01)
*F41A 3/66* (2006.01)
*F41A 3/72* (2006.01)

(52) U.S. Cl.
CPC ..... *F41A 35/06* (2013.01); *F41A 3/66* (2013.01); *F41A 3/72* (2013.01)

(58) Field of Classification Search
CPC ..... F41A 3/72; F41A 35/06
USPC ..... 89/1.4
See application file for complete search history.

(56) References Cited

U.S. PATENT DOCUMENTS 7,240,600 B1 7/2007 Bordson
7,900,546 B2 3/2011 Bordson
8,381,628 B1 2/2013 Wheatley
8,453,365 B1 6/2013 Ballard
9,377,258 B2 6/2016 Gomez
9,482,479 B1 11/2016 Jen
9,541,339 B2 1/2017 Orne, III et al.
9,726,445 B2 8/2017 Gomez
9,733,030 B2 8/2017 Daniel et al.
D796,620 S 9/2017 Geissele
9,846,003 B2 12/2017 Hwang
9,964,370 B2 5/2018 Orne, III et al.
D825,020 S 8/2018 Smith
10,267,580 B2 4/2019 Wheatley
11,015,886 B1 5/2021 Lee
(Continued)

OTHER PUBLICATIONS

Ruger 10/22 ( competition model).
(Continued)

*Primary Examiner* — Reginald S Tillman, Jr.
(74) *Attorney, Agent, or Firm* — Ballard Spahr LLP

(57) ABSTRACT

A charging handle assembly for a rifle has a body extending along a first axis. The body comprises a first side, a second side oppositely disposed, and an opening therebetween. A first handle is connected to the first side and extends away from the body along the first axis. A second handle is connected to the second side and extends away from the body along the first axis. A rod, comprising a first end and a second end, extends through the opening along a longitudinal axis oriented transversely to the first axis. A return spring acts between the body and the first end of the rod and biases the body towards the second end of the rod. The body is movable between the first end and the second end of the rod and compresses the spring when moving towards the first end.

20 Claims, 7 Drawing Sheets

(56) References Cited

U.S. PATENT DOCUMENTS

2014/0196343 A1 7/2014 Wilson et al.

OTHER PUBLICATIONS

Bergara BXR (BXR Carbon—Bergara USA) (https://www.bergara.online/us).
Winchester Wildcat 22 (https://ww.winchesterguns.com/support/owners-manuals/wildcate-owners-manual.html).
Ruger 10/22 Model No. 3110 Calibert: 22LR.
Kidd 10-22 Bolt Handle-Black Ring.
"Advantage" Charging Handle and Picatinny Rail for Ruger® 10/22—Tandemkross https://www.tandemkross.com/Advnatage-Charging-Handle-and-Picatinny-Rail-for-Ruger%C2%1022%AE_p_216.html.
Tactical Innovations® Elite 22LC™ Left Charging Receiver https://www/tacticalinc.com/catalog/product/id-7519.

AMBIDEXTROUS CHARGING HANDLE

CROSS-REFERENCE TO RELATED APPLICATION

This application claims the benefit of the filing date of U.S. Provisional Patent Application No. 63/397,431, filed Aug. 12, 2022, the entirety of which is hereby incorporated by reference herein.

FIELD OF THE INVENTION

This invention relates to charging handles for firearms, in particular, ambidextrous charging handles.

BACKGROUND

Semi-automatic rifles are used by shooters that are left handed, right handed, or ambidextrous. For reliability and ease of use, it is advantageous to accommodate all shooters by implementing rifle designs which emphasize ambidextrous features.

The charging handle is central to the operation of the semi-automatic rifle, as its action draws the bolt out of battery. This action allows the shooter to open the breech and eject spent cartridges from the chamber and load a new round from the magazine. Opening the breech also allows the shooter to verify the chamber is clear of rounds or obstructions and/or clear any stoppages before moving the bolt back into battery. To operate the charging handle, the shooter controls the rifle by holding the grip or forestock of the firearm with one hand while maneuvering the charging handle with the other hand.

There is clearly an opportunity to improve the charging handles of rifles to accommodate left and right handed shooters.

SUMMARY

An example charging handle assembly for carrying a bolt for a firearm according to the invention comprises a body, a first handle, a second handle, a rod, and a return spring. The body extends along a first axis. The body comprises a first side, a second side oppositely disposed, and an opening therebetween. The first handle is connected to the first side and extends away from the body. The second handle connects to the second side and extends away from the body. The rod comprises a first end and a second end. The rod extends through the opening along the longitudinal axis oriented transversely to the first axis. The return spring acts between the body and the first end of the rod. The return spring biases the body towards the second end of the rod. The body is movable between the first end and the second end of the rod. The body compresses the spring when moving towards the first end.

In an example embodiment, the first handle is removably connected to the first side of the body In a further example embodiment, the second handle is removably connected to the second side of the body.

In an example embodiment, the first handle is removably connected via a first male female joint and the second handle is removably connected via a second male female joint.

In an example embodiment, the first handle is removably connected via a first joint and the second handle is removably connected via a second joint. Each of the first joint and the second joint is at least one of a doweled butt joint, a dado joint, a rabbet joint, a dovetail joint, a miter with spline joint, a lap joint, a mortise and tenon joint, or a tongue and groove joint.

In an example embodiment, the first handle is removably connected via a first dovetail joint and the second handle is removably connected via a second dovetail joint.

In an example embodiment, the first handle is removably connected by mating a first projection and a first recess and the second handle is removably connected by mating a second projection and a second recess.

In an example embodiment, the first handle is removably connected via a first fastener to the first side and the second handle is removably connected via a second fastener to the second side.

In an example embodiment, the first end of the rod is configured to engage with a first end of a receiver and the body is configured to move along the rod within the receiver.

In a further example embodiment, the first handle is configured to extend through a first slot in a first side of the receiver and the second handle is configured to extend through a second slot in a second side of the receiver.

In an example embodiment, the first handle and the second handle are offset from each other along a vertical axis.

In an example embodiment, the first slot has a first height and the second slot has a second height different from the first height.

In an example embodiment, the body is engageable with a bolt within the receiver and manual pulling of at least one of the first handle and the second handle moves the body towards the first end of the rod thereby compressing the spring and moving the bolt towards the first end of the receiver.

In an example embodiment, the body defines a recess.

In an example embodiment, the recess is positioned adjacent to the opening.

The invention further encompasses a receiver assembly for a firearm. An example receiver assembly according to the invention comprises a bolt, a receiver, and a charging handle subassembly. The receiver comprises a first end, a second end, a first side, and a second side defining a receiving area configured to house the bolt. The first end opposes the second end. The first side opposes the second side. The charging handle subassembly comprises a body, a first handle, a second handle, a rod, and a return spring. The body extends along a first axis. The body comprises a first side, a second side oppositely disposed, and an opening therebetween. The first handle is connected to the first side and extends away from the body. The second handle connects to the second side and extends away from the body. The rod comprises a first end engageable with the first end of the receiver and a second end. The rod extends through the opening along the longitudinal axis oriented transversely to the first axis. The return spring acts between the body and the first end of the rod. The return spring biases the body towards the second end of the rod. The body is movable between the first end and the second end of the rod within the receiver. The body compresses the spring when moving towards the first end. The bolt moves with the body.

In an example receiver assembly, the first handle is removably connected to the first side of the body.

In a further example receiver assembly, the second handle is removably connected to the second side of the body.

In an example receiver assembly, the first handle is removably connected via a first male female joint and the second handle is removably connected via a second male female joint.

In an example embodiment, the first handle is removably connected via a first joint and the second handle is removably connected via a second joint. Each of the first joint and the second joint is at least one of a doweled butt joint, a dado joint, a rabbet joint, a dovetail joint, a miter with spline joint, a lap joint, a mortise and tenon joint, or a tongue and groove joint.

In an example receiver assembly, the first handle is removably connected via a first dovetail joint and the second handle is removably connected via a second dovetail joint.

In an example receiver assembly, the first handle is removably connected by mating a first projection and a first recess and the second handle is removably connected by mating a second projection and a second recess.

In an example receiver assembly, the first handle is removably connected via a first fastener to the first side and the second handle is removably connected via a second fastener to the second side.

In an example receiver assembly, the first handle is configured to extend through a first slot in the first side of the receiver and the second handle is configured to extend through a second slot in the second side of the receiver.

In an example receiver assembly, the manual pulling of at least one of the first handle and the second handle moves the body towards the first end of the rod thereby compressing the spring and moving the bolt towards the first end of the receiver.

In an example receiver assembly, a recess in the body is positioned adjacent to the opening in the body.

The invention further encompasses a firearm. An example firearm according to the invention comprises a stock, a barrel, and a receiver assembly. The receiver assembly is connected to the barrel and the stock. The receiver assembly comprises a bolt, a receiver, and a charging handle subassembly. The receiver comprises a first end, a second end, a first side, and a second side defining a receiving area configured to house the bolt. The first end opposes the second end. The first side opposes the second side. The charging handle subassembly comprises a body, a first handle, a second handle, a rod, and a return spring. The body extends along a first axis. The body comprises a first side, a second side oppositely disposed, and an opening therebetween. The first handle is connected to the first side and extends away from the body. The second handle connects to the second side and extends away from the body. The rod comprises a first end engageable with the first end of the receiver and a second end. The rod extends through the opening along the longitudinal axis oriented transversely to the first axis. The return spring acts between the body and the first end of the rod. The return spring biases the body towards the second end of the rod. The body is movable between the first end and the second end of the rod within the receiver. The body compresses the spring when moving towards the first end. The bolt moves with the body.

In an example firearm, the first handle is removably connected to the first side of the body.

In a further example firearm, the second handle is removably connected to the second side of the body.

In an example firearm, the first handle is removably connected via a first male female joint and the second handle is removably connected via a second male female joint.

In an example embodiment, the first handle is removably connected via a first joint and the second handle is removably connected via a second joint. Each of the first joint and the second joint is at least one of a doweled butt joint, a dado joint, a rabbet joint, a miter with spline joint, a lap joint, a mortise and tenon joint, or a tongue and groove joint.

In an example firearm, the first handle is removably connected via a first dovetail joint and the second handle is removably connected via a second dovetail joint.

In an example firearm, the first handle is removably connected by mating a first projection and a first recess and the second handle is removably connected by mating a second projection and a second recess.

In an example firearm, the first handle is removably connected via a first fastener to the first side and the second handle is removably connected via a second fastener to the second side.

In an example firearm, the first handle is configured to extend through a first slot in the first side of the receiver and the second handle is configured to extend through a second slot in the second side of the receiver.

In an example firearm, the manual pulling of at least one of the first handle and the second handle moves the body towards the first end of the rod thereby compressing the spring and moving the bolt towards the first end of the receiver.

In an example firearm, the recess in the body is positioned adjacent to the opening in the body.

DETAILED DESCRIPTION

Figure 1:
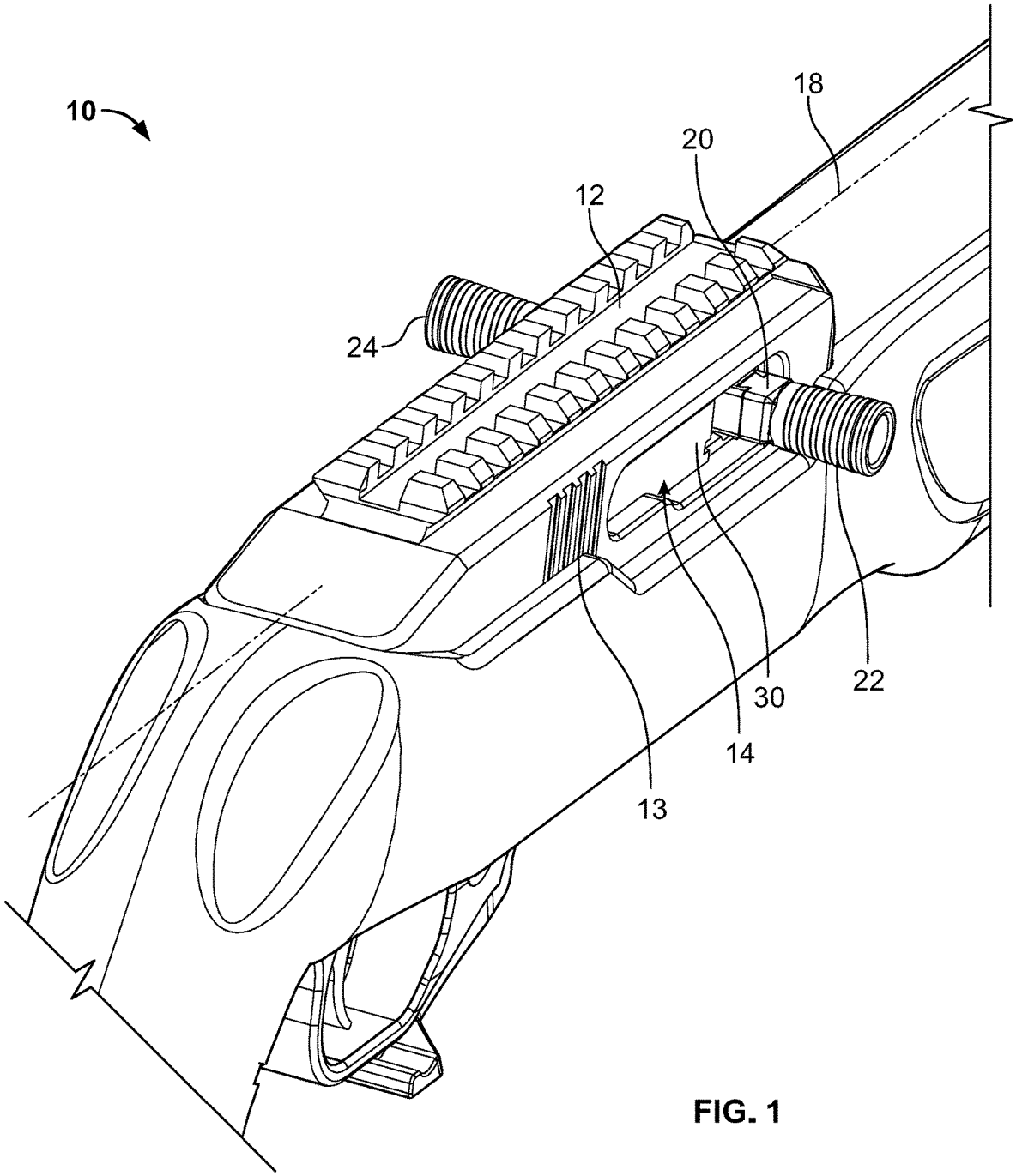
FIG. 1 is an isometric view of an example firearm according to the invention.
Figure 2:
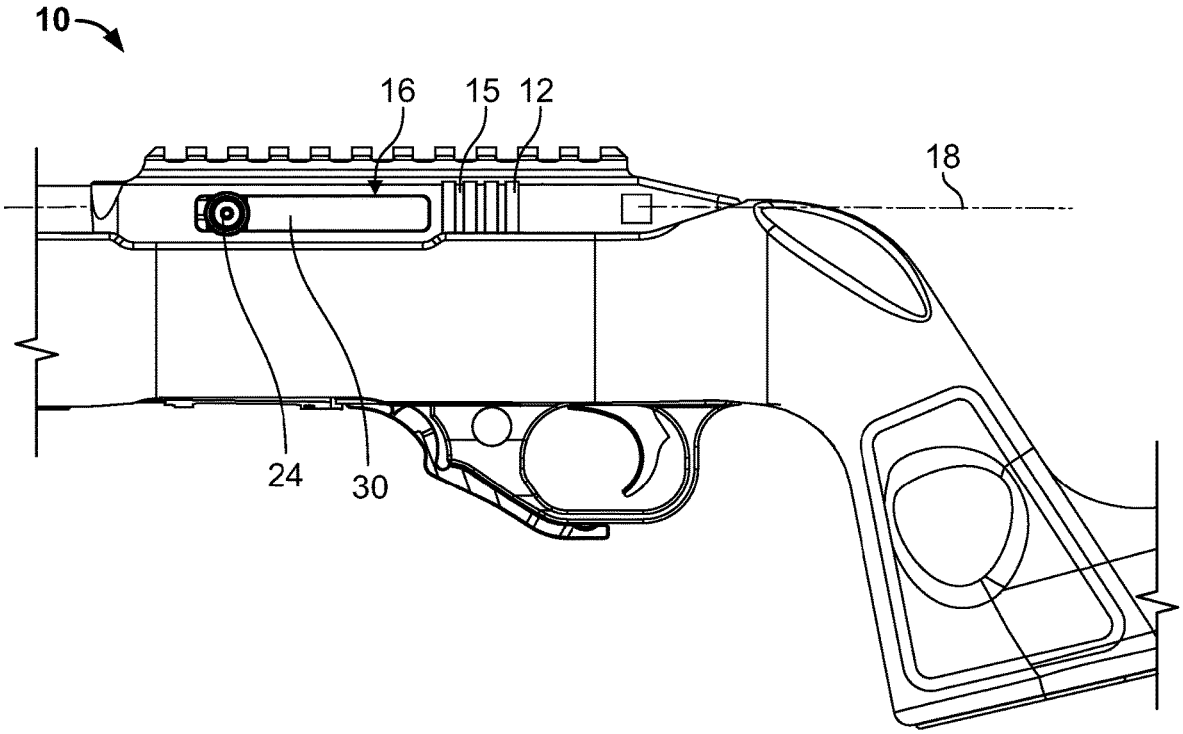
FIG. 2 is a left side view of an example receiver according to the invention.

FIGS. 1 and 2 show an example semi-automatic rifle 10 having a receiver 12. The receiver 12 defines an interior space which houses a charging handle assembly 20 and a bolt 30. The example charging handle assembly 20 includes a first handle 22 and a second handle 24 extending outwardly away from the right and left sides of the receiver 12, respectively. The handles 22, 24 extend through slots 14, 16 in a first side 13 and a second side 15 in the receiver 12. The slots 14, 16 are elongated to allow the handles 22, 24 to slide within the slots 14, 16 along a longitudinal axis 18.

Figure 3:
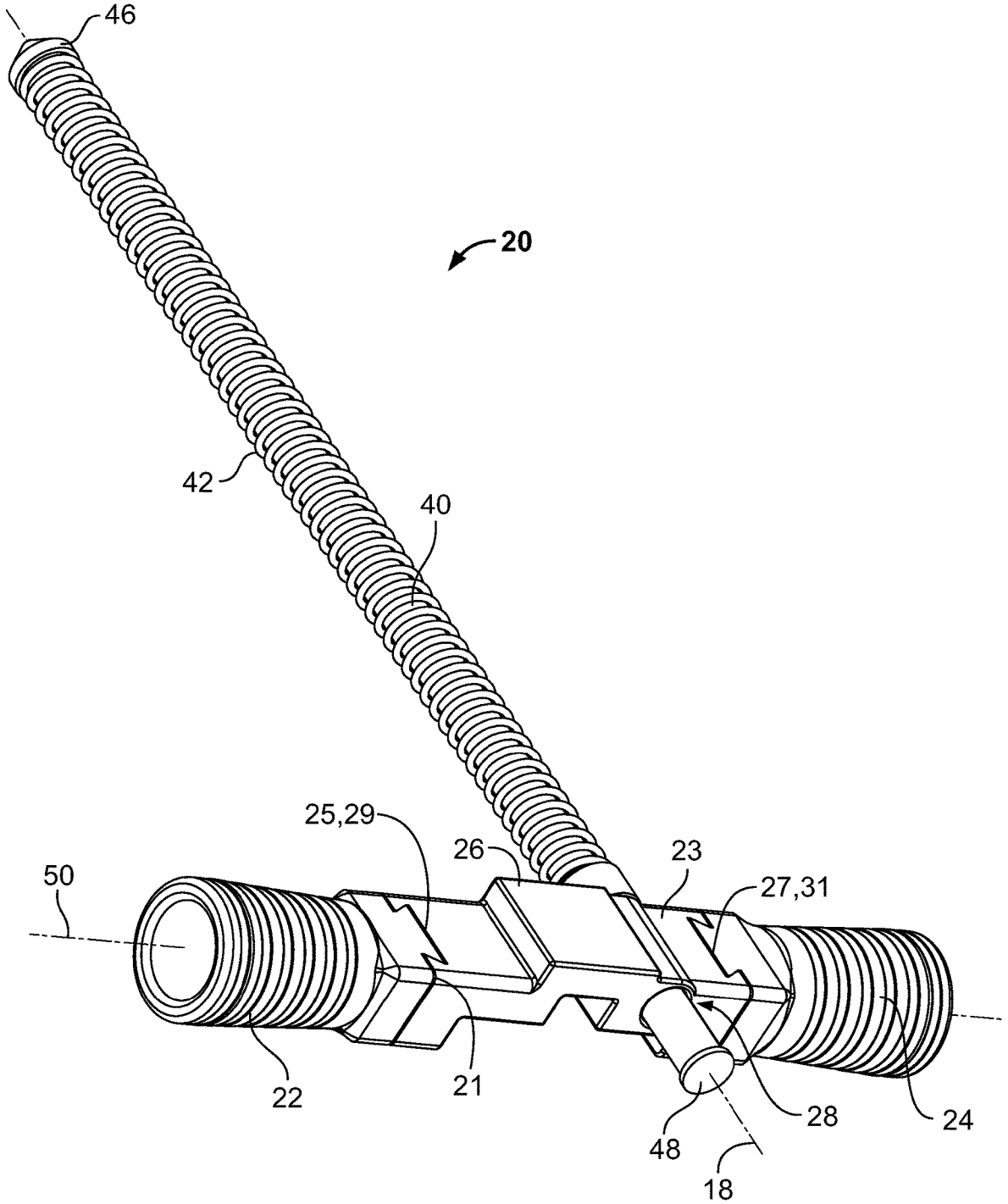
FIG. 3 is an isometric view of an example charging handle according to the invention.
Figure 4:
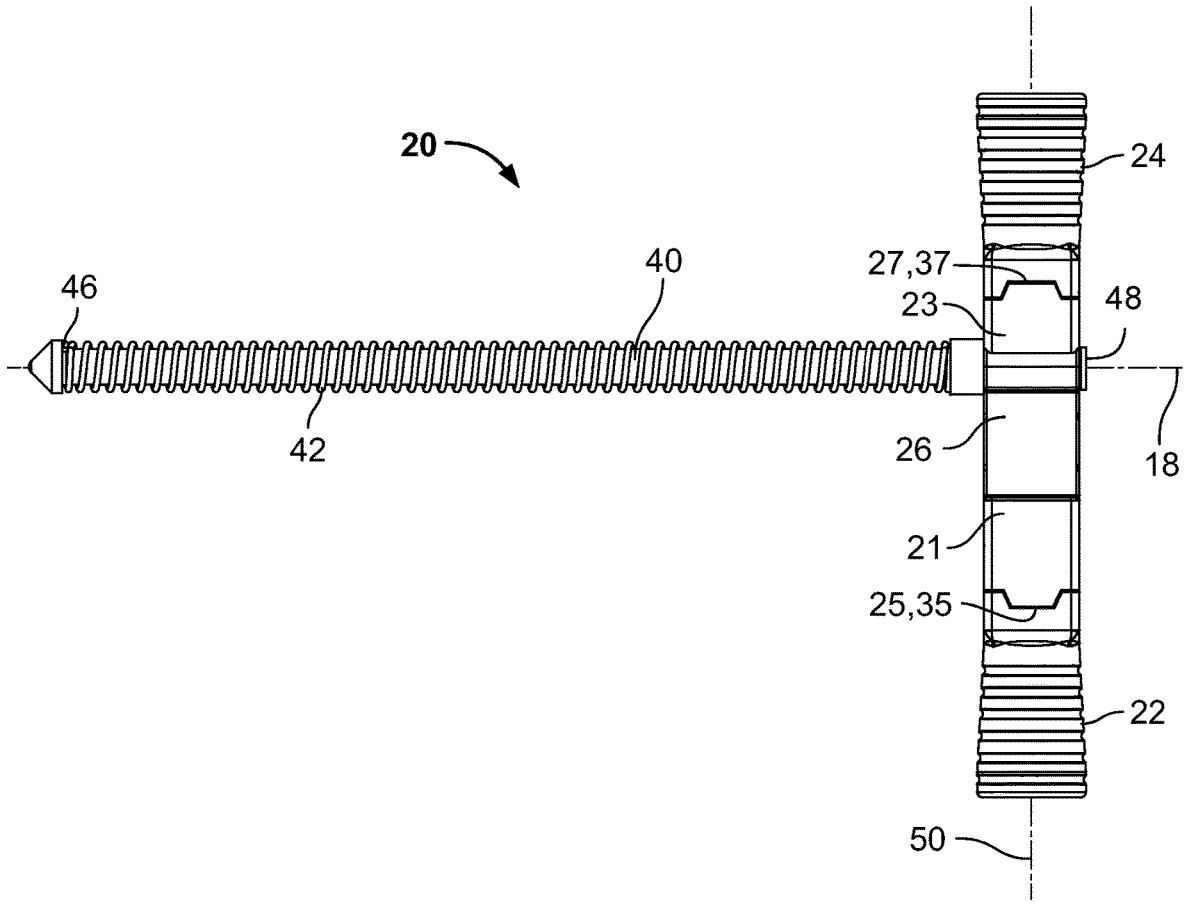
FIG. 4 is a top view of an alternative embodiment of an example charging handle according to the invention.

FIGS. 3 and 4 show an example charging handle assembly 20 according to the invention. The charging handle assembly 20 includes a body 26 extending along a first axis 50 oriented transversely to the longitudinal axis 18. The charging handle assembly 20 includes a first side 21 configured to connect to the first handle 22. The charging handle assembly 20 includes a second side 23 configured to connect to the second handle 24. The first handle 22 and the second handle 24 extend out from the body 26 along the first axis 50 providing the shooter quick and easy access to engage the charging handle 20. The first handle 22 and second handle 24 may be removably connected via various types of mechanical joints. For example, the mechanical joint may be a doweled butt joint, a dado joint, a rabbet joint, a dovetail joint, a miter with spline joint, a lap joint, a mortise and tenon joint, or a tongue and groove joint. The first handle 22 and second handle 24 may be removably connected to the first side 21 and second side 23 of the body 26 via male female joints 25, 27. As shown in FIG. 3, the first handle 22 and second handle 24 may be attached to the first side 21 and the second side 23 via dovetail joints 29, 31. Alternatively as shown in FIG. 4, the first handle 22 and second handle 24 may be attached to the first side 21 and the second side 23 via geometrically corresponding protrusions and recesses 35, 37 (e.g., with the recesses configured to complementarily receive respective, corresponding protrusions).

Figure 5A:
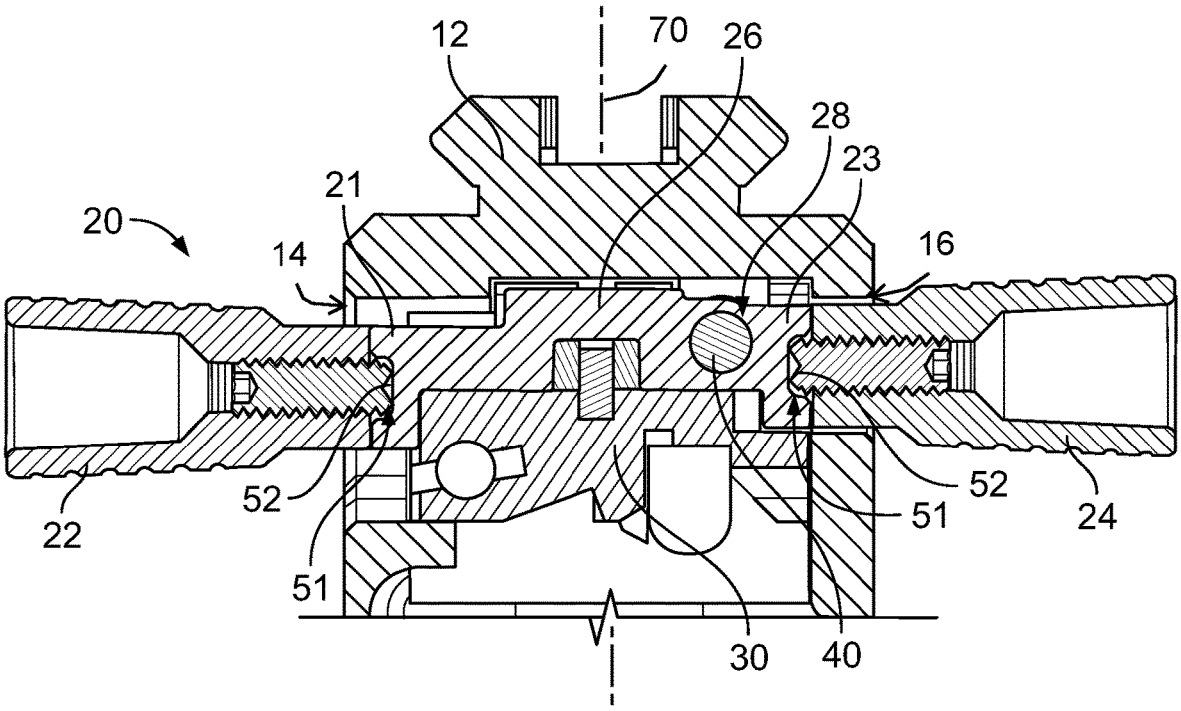
FIG. 5A is a section view of an example charging handle and bolt according to the invention.
Figure 5B:
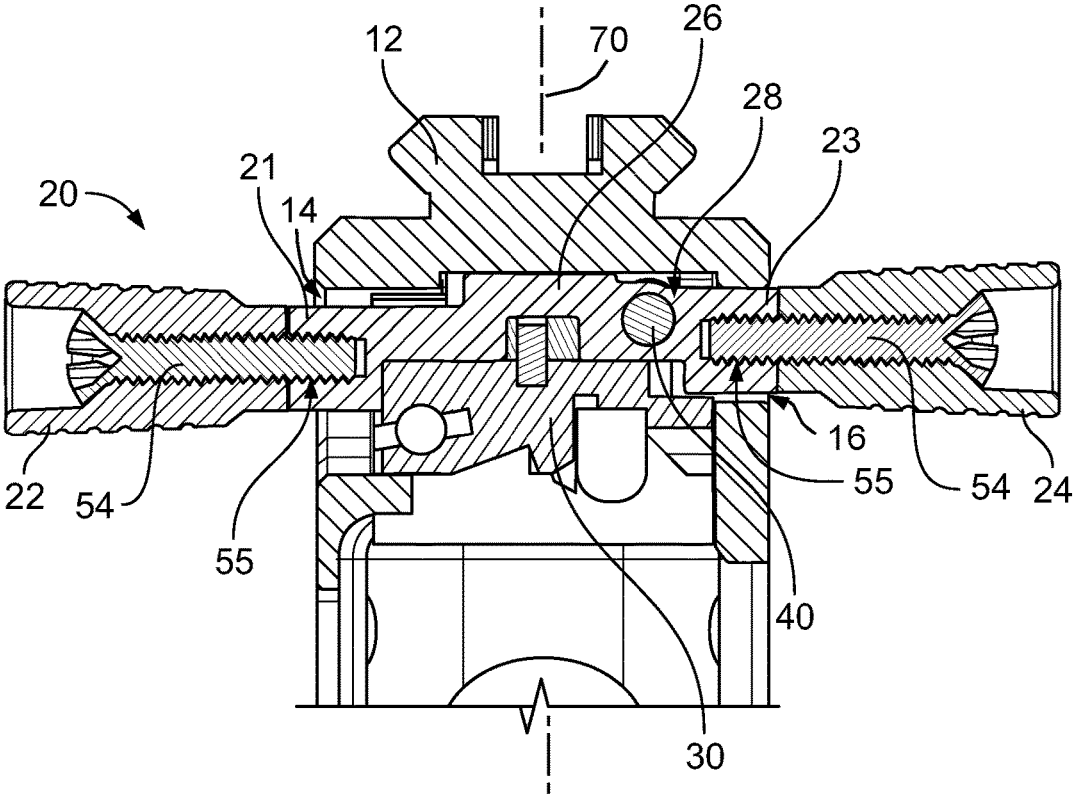
FIG. 5B is a section view of an alternative embodiment of an example charging handle and bolt according to the invention.

As shown in FIG. 5A, alternatively or in addition, the first handle 22 and the second handle 24 may be removably connected to the first side 21 and the second side 23 with fasteners 52 (e.g., set screws or similar fasteners). The first handle 22 and the second handle 24 may include axially threaded openings to receive the set screws 52. The first side 21 and the second side 23 may each include a recessed pocket 51 configured to bed the set screw 52 to assist in aligning the first handle 22 and the second handle 24 to the body 26 upon assembly. As shown in FIG. 5B, alternatively or in addition, the first handle 22 and the second handle 24 may be removably connected to the first side 21 and the second side 23 with fasteners 54, such as screws. The body 26 may include threaded openings 55 to receive the fasteners 54. The first handle 22 and the second handle 24 may be completely removed when the rifle 10 is not in use to improve carrying and transportation conditions. As shown in FIGS. 5A and 5B, the first handle 22 and the second handle 24 may be offset from each other along a vertical axis 70. The slots 14, 16 may have different heights to accommodate the location and offset nature of the first handle 22 and second handle 24.

The body 26 also includes an opening 28 configured to receive a rod 40. The rod 40 extends through the opening 28 along the longitudinal axis 18. The rod 40 includes a first end 46 and a second end 48. The body 26 is configured to move along the rod 40 between the first end 46 and the second end 48. The rod 40 extends through the center of a return spring 42. The return spring 42 acts between the first end 46 and the body 26 thereby biasing the body 26 towards the second end 48 of the rod 40. The body 26 is configured to move along the rod 40 (and, thus, along the longitudinal axis 18). As the body 26 move towards the first end 46 of the rod 40, the body 26 compresses the return spring 42. Optionally, the second handle 24 may be offset from the first handle 22 along the vertical axis 70. For example, as shown in FIGS. 5A-5B, the second handle 24 may be positioned higher along the vertical axis 70, to provide more support and stability at a position near the rod 40.

Figure 6:
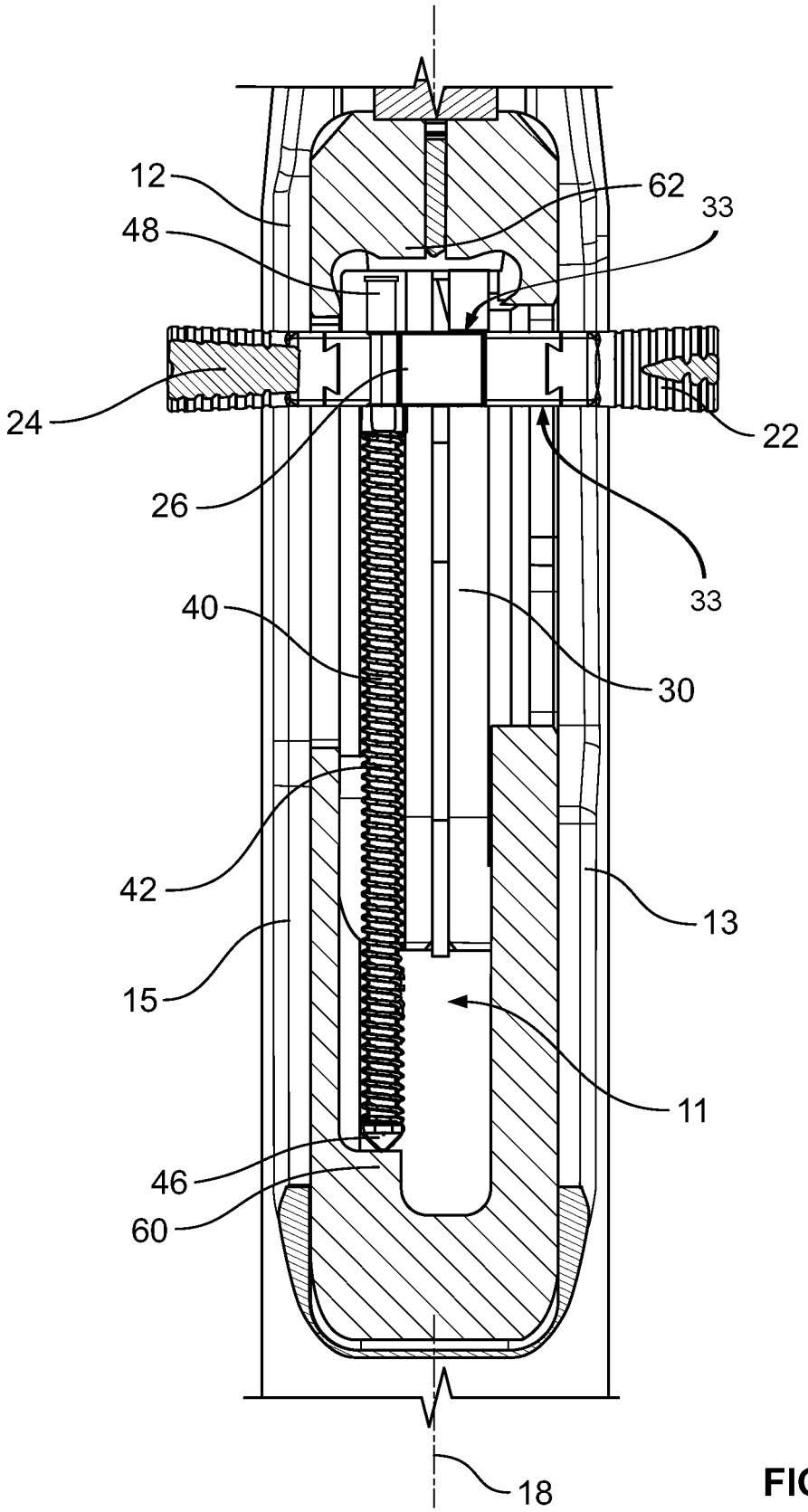
FIG. 6 is a top section view of an example receiver assembly according to the invention.

As shown in FIG. 6, the body 26 of the charging handle 20 may be mounted within a recess 33 defined by the bolt 30. The body 26 moves the bolt 30 along the longitudinal axis 18 when the body 26 moves along the rod 40.

As shown in FIG. 6, the charging handle assembly 20 and the bolt 30 are mounted within the receiver 12. In some examples, the combination of the charging handle assembly 20, the bolt 30, and the receiver 12 are referred to herein as a "receiver assembly," with the charging handle assembly being referred to as a "charging handle subassembly" for clarity. The charging handle assembly 20 and the bolt 30 are housed within a receiving area 11 defined by a first end 60, a second end 62, the first side 13, and the second side 15. The first end 46 of the rod 40 engages with the first end 60 of the receiver 12. The first end 60 of the receiver 12 and the opening 28 within the body 26 brace the rod 40 within the receiver 12. As shown in FIG. 6, the return spring 42 biases the body 26 of the charging handle assembly 20 and the bolt 30 mounted to the body 26 towards the second end 62 of the receiver 12 thereby positioning the bolt 30 into battery.

Figure 7:
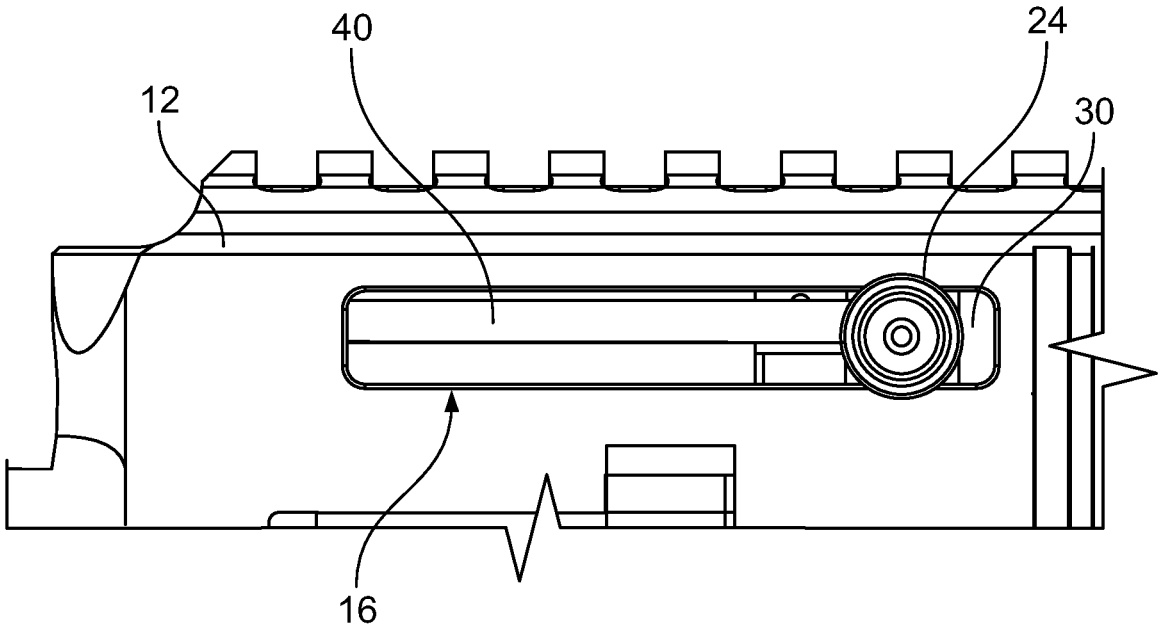
FIG. 7 is a left side view of the example receiver according to the invention with the bolt out of battery.

When the first handle 22 or second handle 24 of the charging handle assembly 20 is pulled by a shooter, the body 26, and therefore, the bolt 30, move along the longitudinal axis 18 towards the first end 60 of the receiver 12 compressing the return spring 42. As shown in FIG. 7, as the body 26 moves to the first end 60 of the receiver 12, it draws the bolt 30 out of battery. This action allows a shooter to open the breech and eject spent rounds. This action also allows a shooter to load a new round from a magazine. When a new magazine is loaded, the first handle 22 or second handle 24 is pulled and then subsequently released. After the charging handle 20 is released, the return spring 42 biases the bolt 30 towards the second end 62 of the receiver 12 back into battery, stripping and chambering a new round from a magazine.

Because the first handle 22 extends from the right side of the receiver 12 and the second handle 24 extends from the left side of the receiver 12, a shooter may hold the grip or forestock of the rifle 10 with either the left or right hand while using the other hand to pull the charging handle 20 via the first handle 22 or the second handle 24. This feature thereby accommodates left and right handed shooters by allowing shooters having either right or left hand dominance to open the breech and/or load a new round from a magazine.

It is expected that the example charging handle assembly 20 according to the invention will improve ease and reliability of a rifle for left and right handed shooters.

All of the embodiments of the claimed invention described herein are provided expressly by way of example only. Innumerable variations and modifications may be made to the example embodiments described herein without departing from the concept of this disclosure. Additionally, the scope of this disclosure is intended to encompass any and all modifications and combinations of all elements, features, and aspects described in the specification and claims, and shown in the drawings. Any and all such modifications and combinations are intended to be within the scope of this disclosure.

What is claimed is:

1. A charging handle assembly for carrying a bolt for a firearm, said charging handle assembly comprising:

a body extending along a first axis, said body comprising a first side, a second side oppositely disposed, and an opening therebetween;

a first handle connected to said first side and extending away from said body;

a second handle connected to said second side and extending away from said body;

a rod comprising a first end and a second end, said rod extending through said opening along a longitudinal axis oriented transversely to said first axis; and a return spring acting between said body and said first end of said rod and biasing said body towards said second end of said rod, wherein said body is movable between said first end and said second end of said rod and compresses said spring when moving towards said first end.

2. The charging handle assembly according to claim 1, wherein each of said first handle and said second handle is removably connected to said body.

3. The charging handle assembly according to claim 2, wherein said first handle is removably connected via a first joint and said second handle is removably connected via a second joint, wherein each of said first joint and said second joint is at least one of a doweled butt joint, a dado joint, a rabbet joint, a miter with spline joint, a lap joint, a mortise and tenon joint, or a tongue and groove joint.

4. The charging handle assembly according to claim 2, wherein said first handle is removably connected via a first dovetail joint and said second handle is removably connected via a second dovetail joint.

5. The charging handle assembly according to claim 2, wherein said first handle is removably connected by mating a first projection and a first recess and said second handle is removably connected by mating a second projection and a second recess.

6. The charging handle assembly according to claim 2, wherein said first handle is removably connected via a first fastener to said first side and said second handle is removably connected via a second fastener to said second side.

7. The charging handle assembly according to claim 1, wherein said first end of said rod is configured to engage with a first end of a receiver and said body is configured to move along said rod within said receiver.

8. The charging handle assembly according to claim 7, wherein said body is engageable with a bolt within said receiver, wherein said charging handle assembly is configured such that manual pulling of at least one of said first handle and said second handle moves said body towards said first end of said rod thereby compressing said spring and moving said bolt towards said first end of said receiver.

9. The charging handle assembly according to claim 7, wherein said first handle is configured to extend through a first slot in a first side of said receiver and said second handle is configured to extend through a second slot in a second side of said receiver.

10. The charging handle assembly according to claim 9, wherein said first handle and said second handle are offset along a vertical axis.

11. The charging handle assembly according to claim 10, wherein said first slot has a first height and said second slot has a second height different from said first height.

12. A receiver assembly for a firearm, said receiver assembly comprising:

a bolt;

a receiver comprising a first end, a second end, a first side, and a second side defining a receiving area configured to house said bolt, said first end opposing said second end, and said first side opposing said second side; and a charging handle subassembly comprising:

a body extending along a first axis, said body comprising a first side, a second side oppositely disposed, and an opening therebetween;

a first handle connected to said first side and extending away from said body;

a second handle connected to said second side and extending away from said body;

a rod comprising a first end engageable with said first end of said receiver and a second end, said rod extending through said opening in said body along a longitudinal axis oriented transversely to said first axis; and a return spring acting between said body and said first end of said rod and biasing said body towards said second end of said rod, wherein said body is movable between said first end and said second end of said rod within said receiver and compresses said spring when moving towards said first end, wherein said bolt moves with said body.

13. The receiver assembly according to claim 12, wherein each of said first handle and said second handle is removably connected to said body.

14. The receiver assembly according to claim 12, wherein said first handle is configured to extend through a first slot in said first side of said receiver and said second handle is configured to extend through a second slot in said second side of said receiver.

15. The receiver assembly according to claim 12, said charging handle subassembly is configured such that manual pulling of at least one of said first handle and said second handle moves said body towards said first end of said rod thereby compressing said spring and moving said bolt towards said first end of said receiver.

16. The receiver assembly according to claim 12, wherein said first handle and said second handle are offset along a vertical axis.

17. A firearm comprising:

a stock;

a barrel; and a receiver assembly connected to said barrel and said stock, said receiver assembly comprising:

a bolt;

a receiver comprising a first end, a second end, a first side, and a second side defining a receiving area configured to house said bolt, said first end opposing said second end, and said first side opposing said second side; and a charging handle subassembly comprising:

a body extending along a first axis, said body comprising a first side, a second side oppositely disposed, and an opening therebetween;

a first handle connected to said first side and extending away from said body along said first axis;

a second handle connected to said second side and extending away from said body along said first axis;

a rod comprising a first end engageable with said first end of said receiver and a second end, said rod extending through said opening in said body along a longitudinal axis oriented transversely to said first axis; and a return spring acting between said body and said first end of said rod and biasing said body towards said second end of said rod, wherein said body is movable between said first end and said second end of said rod within said receiver and compresses said spring when moving towards said first end, wherein said bolt moves with said body.

18. The firearm according to claim 17, wherein said first handle is configured to extend through a first slot in said first side of said receiver and said second handle is configured to extend through a second slot in said second side of said receiver.

19. The firearm according to claim 17, wherein manual pulling of at least one of said first handle and said second handle moves said body towards said first end of said rod thereby compressing said spring and moving said bolt towards said first end of said receiver.

20. The firearm according to claim 17, wherein said first handle and said second handle are offset along a vertical axis.

* * * * *